United States Patent [19]

Politzer et al.

[11] 3,985,059

[45] Oct. 12, 1976

[54] CLAMPING DEVICE FOR SEALING RINGS ON A TILTABLE CARTRIDGE CHAMBER FOR A WEAPON

[75] Inventors: Anton Politzer, Lauf, Pegnitz; Hans Sackenreuter, Ruckersdorf; Wilhelm Machmer, Nurnberg, all of Germany

[73] Assignee: DIEHL, Nurnberg, Germany

[22] Filed: Mar. 12, 1975

[21] Appl. No.: 557,653

[30] Foreign Application Priority Data

Mar. 13, 1974 Germany ..... 2412042
Mar. 13, 1974 Germany ..... 2412043
Apr. 3, 1974 Germany ..... 7411702[U]

[52] U.S. Cl. ..... 89/25; 89/26
[51] Int. Cl.[2] ..... F41F 11/04
[58] Field of Search ..... 89/25, 26, 17; 42/9

[56] References Cited

UNITED STATES PATENTS 3,892,163 7/1975 Asikainen ..... 89/25 X

FOREIGN PATENTS OR APPLICATIONS 73,513 8/1944 Czechoslovakia ..... 89/25
869,271 5/1961 United Kingdom ..... 89/37 C

*Primary Examiner*—David H. Brown
*Attorney, Agent, or Firm*—Walter Becker

[57] ABSTRACT

A weapon having a tiltable cartridge chamber with sealing rings at opposite ends of the cartridge chamber for sealing engagement with the weapon barrel and with a head. A clamping lever is tiltably mounted on the chamber and is connected to the sealing rings for movement of the sealing rings to and from sealing position. A compensating mechanism is interposed between the lever and the sealing rings so that when one sealing ring seats, movement of the lever can continue and advance the other ring into seated position.

12 Claims, 8 Drawing Figures

CLAMPING DEVICE FOR SEALING RINGS ON A TILTABLE CARTRIDGE CHAMBER FOR A WEAPON

The present invention relates to a clamping device for sealing rings on a large caliber weapon.

A large caliber weapon has been suggested which is equipped with a cartridge chamber which is pivotable into the axis of the bore of a weapon tube and which is provided with sealing rings adapted at the end face by means of clamping elements to be pressed against sealing surfaces of the weapon tube or the weapon bottom.

The object of this weapon system which is suitable for instance for mortar consists in effectively sealing the cartridge chamber in its firing position at both sides.

The object of the present invention consists in providing a clamping device for sealing rings which simultaneously moves the sealing rings in opposite direction and presses the same against stationary sealing surfaces of the weapon tube or weapon bottom.

This object and other objects and advantages of the invention will appear more clearly from the following specification in connection with the accompanying drawings, in which.

Figure 5:
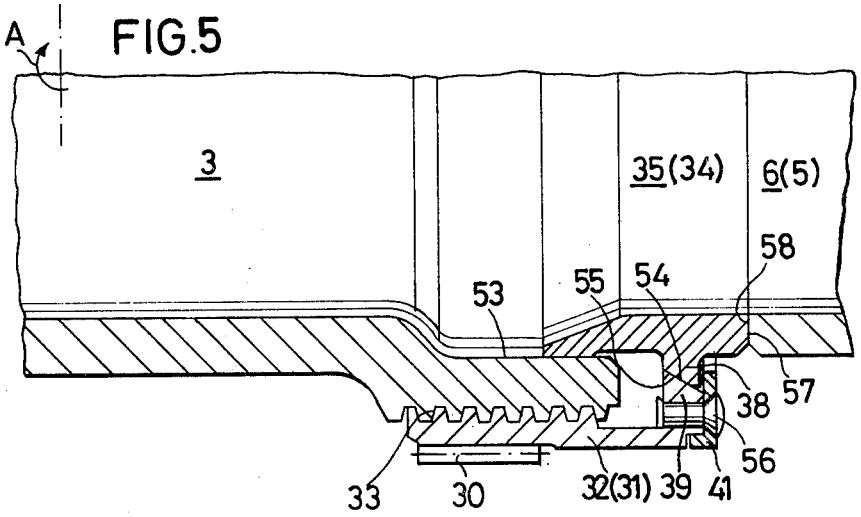
Figure 6:
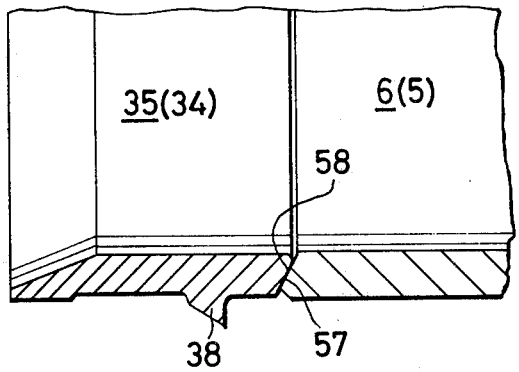
Figure 7:
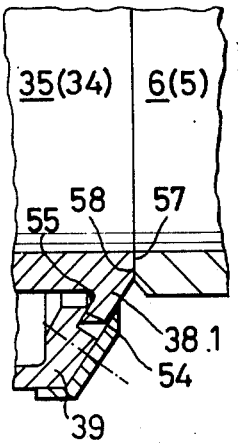

FIGS. 5–7 respectively illustrate different sealing ring arrangements.

Figure 8:
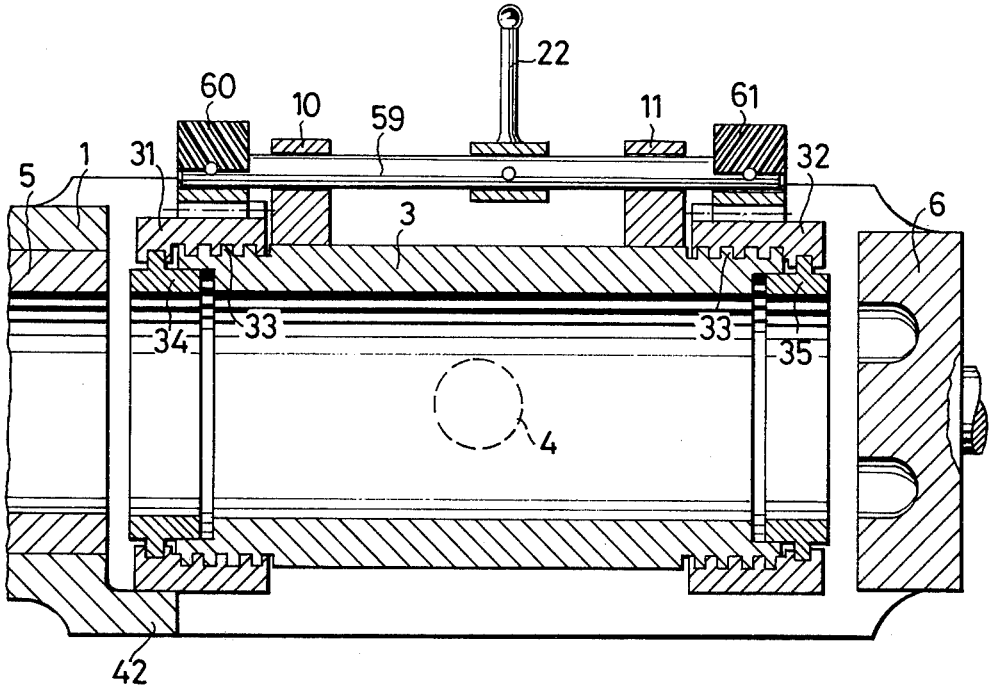

FIG. 8 is a section through another modified clamping device according to the invention.

The clamping device according to the invention for sealing rings mounted in clamping nuts on a large caliber weapon which comprises a weapon tube section designed as cartridge chamber and pivotable by a clamping lever and furthermore comprises a clamping device arranged on the cartridge chamber and including said clamping lever, a clamping shaft and a gear or screw driven transmission is characterized primarily in that the clamping shaft is divided into two output shafts which are adapted to be driven by the clamping lever through the intervention of a compensating transmission for axially displacing the sealing rings which at both ends of the cartridge chamber are guided by clamping nuts.

A centering of the cartridge chamber in its basic position is obtained by the fact that a compensating body is provided which has two abutments which in the disengaged position of the clamping lever engage a surface on the side of the cartridge chamber and align the sealing rings in their respective starting position.

This arrangement has the advantage that a clamping of the sealing rings is possible only after a centering has been effected.

Figure 1:
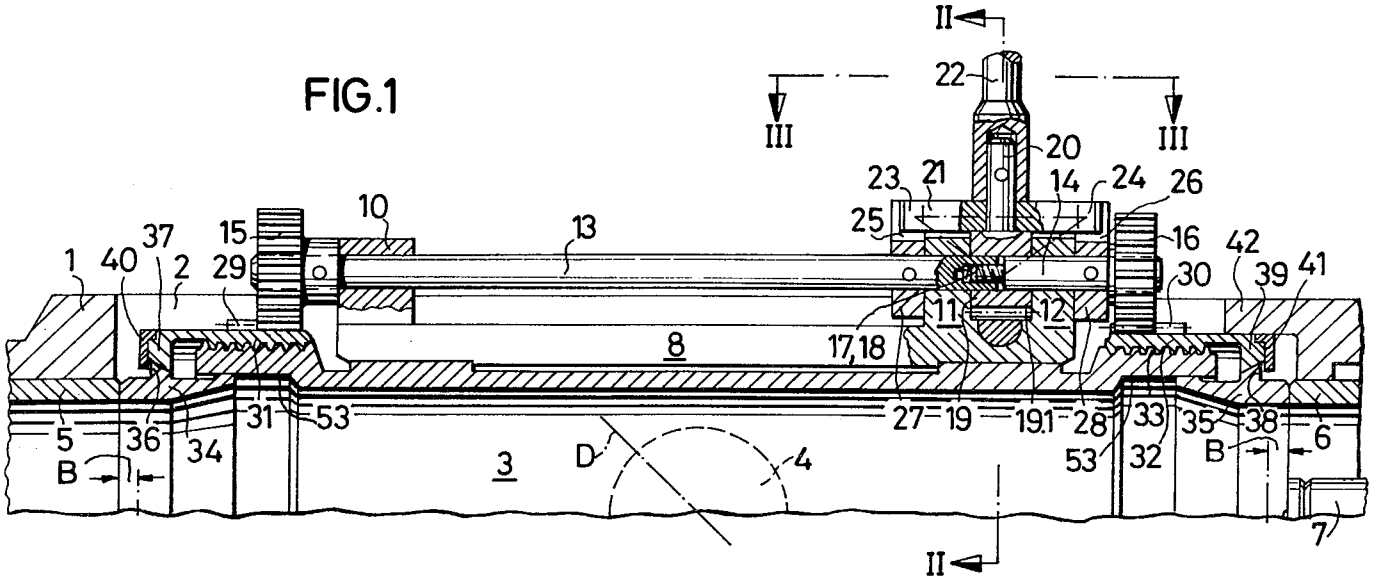
FIG. 1 illustrates a longitudinal section through a portion of the cartridge chamber with a clamping device according to the invention.
Figure 2:
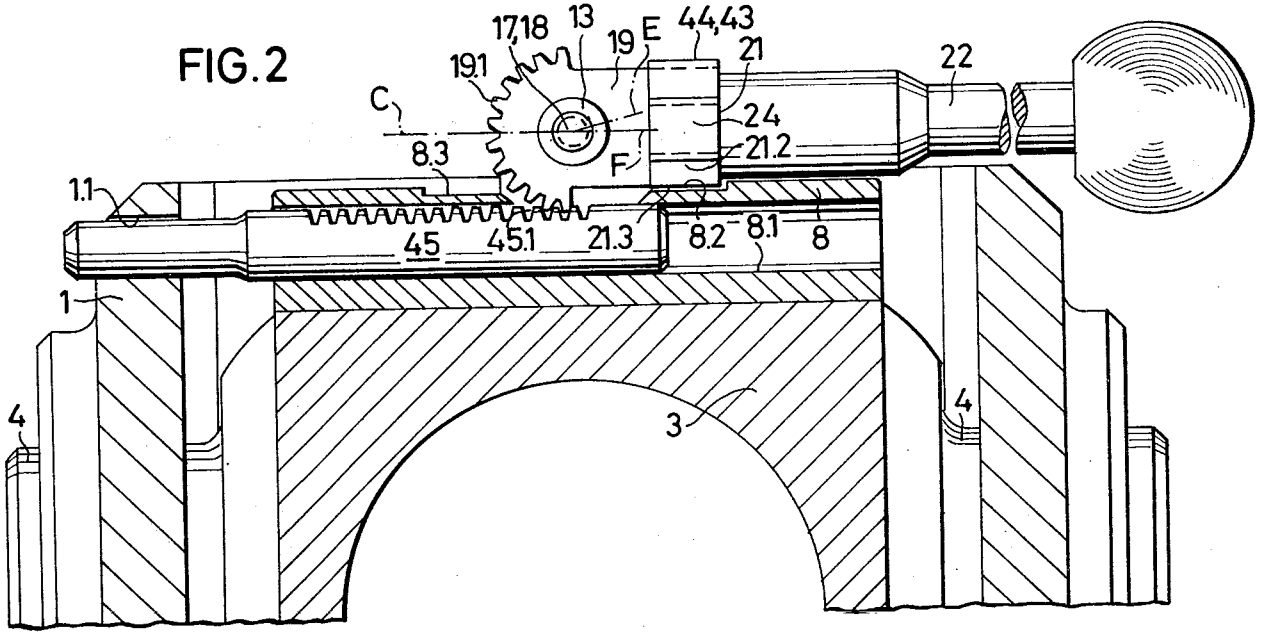
FIG. 2 represents a section taken along the line II—II of FIG. 1.

Referring now to the drawings in detail, the arrangement in FIGS. 1 and 2 comprises a housing 1 in which a chute-like recess 2 is provided. In said recess 2 there is pivotally journalled a pivotable cartridge chamber 3. The pivoting of said cartridge chamber 3 is effected by pins or pivots 4 journalled in the housing 1. Also provided in the housing 1 is a weapon tube 5, and a bottom member 6 with an ignition device 7. The cartridge chamber 3 carries a plate 8 with three supports 10-12 in which two coaxially arranged output shafts 13, 14 with gears 15, 16 are mounted. The output shafts 13, 14 are rotatable relative to each other through the intervention of a thread-pin connection 17, 18. Between the supports 11, 12 and on the output shafts 13, 14 there is provided a disc 19 with a pin 20. Pin 20 carries a pivotable compensating body 21 (FIG. 3) and also carries a clamping lever 22 which is rigidly connected to said compensating body 21.

Figure 3:
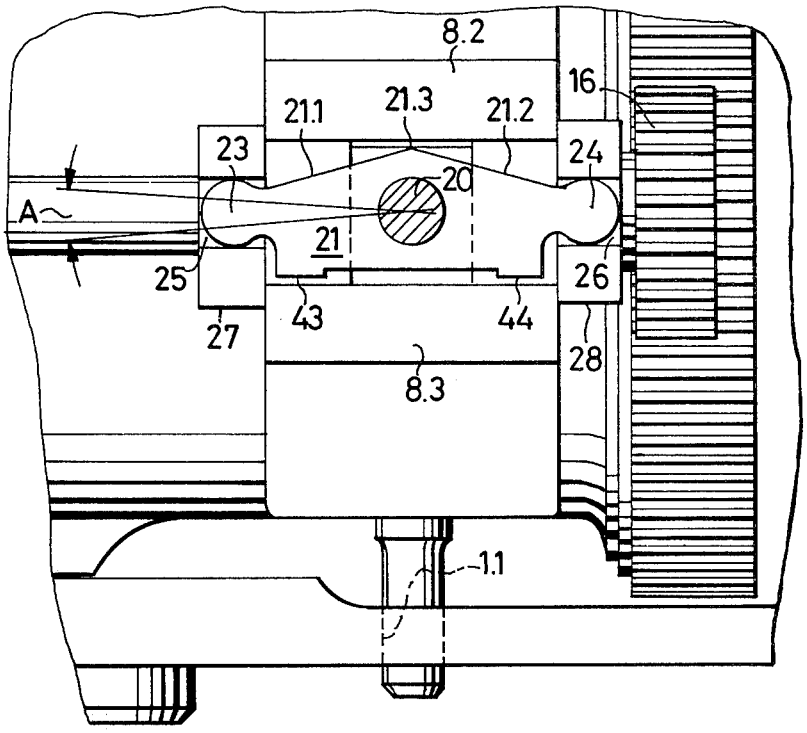
FIG. 3 represents a view taken along the line III—III of FIG. 1.

According to FIG. 3, the compensating body 21 comprises two cams 23, 24 which respectively engage recesses 25, 26 provided in discs 27, 28 which are arranged on the output shafts 13, 14.

The gears 15, 16 arranged on the output shafts 13, 14 engage clamping nuts 31, 32 which are screwed onto the end face of the cartridge chamber 3 and are respectively provided with clamping nuts 31, 32 of a segmental gearing 29, 30. As screw connection there is provided a trapezoidal thread 33.

According to FIG. 5, sealing rings 34, 35 are displaceable by clamping nuts 31, 32 in guiding bores 53 of the cartridge chamber 3. To this end, the sealing rings 34, 35 and the clamping nuts comprise flanges 36–39 which are equipped with conical surfaces 54, 55 corresponding to each other. For purposes of securing the position of the sealing rings 34, 35 on the clamping nuts 31, 32 there are provided holding rings 40, 41 which by means of rivets 56 are connected to said clamping nuts 31, 32. The sealing surfaces 57, 58 at the end faces of the sealing ring 35 and bottom member 6 are located at the right angle to the axis of the bore. In contrast thereto, the sealing surfaces 57, 58 according to FIG. 6 are conical or spherical shaped. The sealing surfaces 57, 58 according to FIG. 7 are located at the right angle to the axis of the bore. Flange 38.1 rests by means of a conical inner contacting surface 55 against a correspondingly conical outer contacting surface 54 of the flange 39.

For properly locating the cartridge chamber 3 in its basic position, according to FIG. 1 an abutment 42 on the housing side is provided.

According to FIG. 2, the disc 19 which supports the clamping lever 22 and the compensating body 21 is provided with a gear segment 19.1 which engages teeth 45.1 of a centering pin 45. The centering pin 45 is displaceably mounted in a bore 8.1 of the plate 8. A central bore 1.1 is coaxially arranged with regard to said bore 8.1 in the housing 1.

According to FIG. 3, the compensating body is in conformity with the maximum compensating angle A designed in the manner of a roof edge and additionally comprises abutments 43, 44 which when abutting surface 8.3 so define a starting position of the clamping device that the sealing rings 34, 35 have the same distance B to the sealing surfaces located opposite thereto and pertaining to the weapon tube or the bottom member 6.

One of the roof edge surfaces 21.1, 21.2 will when clamping the sealing rings 34, 35 engage the surface 8.2 of plate 8 (FIG. 2). Between the surfaces 21.1, 21.2, an abutment edge 21.3 is located which when the clamping lever 22 occupies the position shown in FIG. 2, engages the surface 8.2.

For purposes of pivoting the cartridge chamber, shown in its basic position in FIG. 2, into loading position, the clamping lever 22 is moved into the position C. In this position, the centering pin 45 as well as the sealing rings 34, 35 occupy their ineffective positions B. Subsequently, through the intervention of the clamping lever 22, a pivoting movement of the carriage chamber 3 about pivot 4 into the desired loading position is effected (position D, FIG. 1). After a non-illustrated cartridge has been introduced, the cartridge chamber 3 is pivoted back to its basic position (FIG. 1) until it engages the abutment 42. The clamping lever 22 is then for centering the cartridge chamber 3 pivoted into the position E while moving pin 45 into its FIG. 2 position.

When the sealing rings 34, 35 cannot simultaneously engage the weapon tube 5 and bottom member 6, for instance when sealing ring 35 already is in its engaging position, the thus unilaterally fixed compensating body 21 is held pivotable through the intervention of the output shaft 13 and the cam 23 in such a way that in response to a further movement of the clamping lever 22, the compensating body 21 pivots about a pin 20. As a result thereof, the cam 24 can carry out a compensating movement by half of the compensating angle A. This compensating movement moves the sealing ring 35 to its sealing surface of the bottom member 6. As a result thereof, tolerances of a few thousandths mm can be compensated for. Only when both sealing rings 34, 35 engage their sealing surfaces, a short movement of the clamping lever 22 into the indicated position F will bring about the locking or clamping of the sealing rings 34, 35.

The sealing positions of the sealing rings 35 illustrated in FIGS. 5–7 are brought about by the axially displaceable clamping nuts 32. In this connection, the conical contacting surfaces 54, 55 between the clamping nut 32 and the sealing ring 35 will center the sealing ring 35 with regard to the bottom member 6 or weapon tube 5 so that a high supporting surface portion and a uniform specific surface pressure will be realized. Due to the gas pressure of the ignited cartridge, the sealing rings 34, 35 are additionally pressed against their sealing surfaces. The relieving or disengaging of the clamping device is effected in the inverse sequence.

Figure 4:
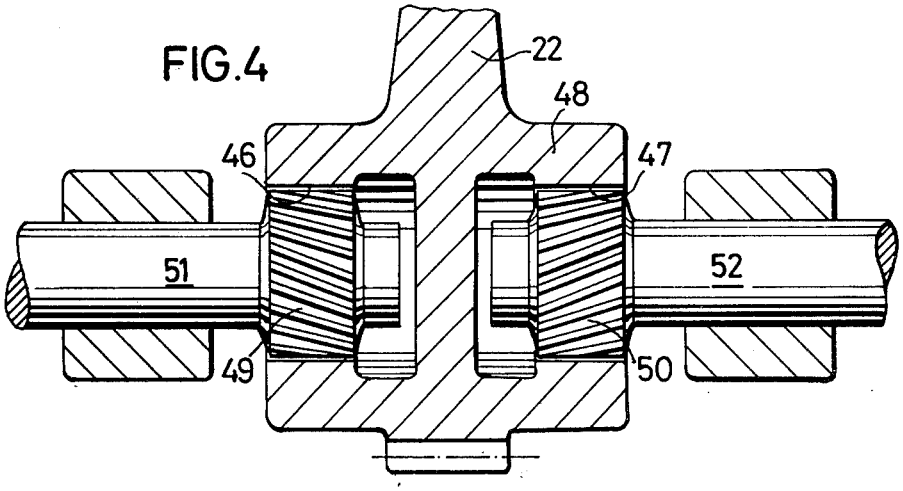
FIG. 4 illustrates the principle of a further clamping device according to the invention.

The function of the compensating body according to FIG. 3 can according to FIG. 4 also be carried out by a planetary gear body 48 with inner teeth 46, 47. To this end, the planetary gear body 48 is provided with oppositely directed inclined teeth meshing with corresponding gears 49, 50 of the axially displaceably mounted output shafts 51, 52. A compensation of the sealing rings which are in engagement at different times, is effected by the fact the when the output shaft 51 is firmly located, the planetary gear body 48 is axially displaceable along the gear flank over the gear 49 and thereby drives the output shaft 52 for fixing the not yet engaging sealing ring.

Instead of the compensating transmission described in connection with FIGS. 1 and 4, also a dish or bevel gear transmission may be employed.

FIG. 8 illustrates how instead of the compensating transmission with two output shafts according to FIGS. 1–4, there may be provided a compensating transmission with a transmission shaft 59 while on the transmission shaft 59 two gears 60, 61 with oppositely inclined teeth are provided. These gears mesh with corresponding clamping nuts 31, 32. The pivoting of the cartridge bearing 3 and the subsequent sealing of the latter is effected by means of the clamping lever. A stroke compensation with only one engaging sealing ring 34, 35 is effected by the gears 60, 61 or clamping nuts 31, 32. In this connection, the transmission shaft turned about its axis slides in the loose bearings 10, 11 to the sealing engagement of the sealing rings 34, 35 to be applied.

It is, of course, to be understood that the present invention is, by no means, limited to the specific showing in the drawings, but also comprises any modifications within the scope of the appended claims.

What is claimed is:

1. In a clamping device for clamping seal rings at the ends of a tiltable cartridge chamber in sealing position against a weapon tube at one end of the chamber and a head at the other end of the chamber, clamp shaft means rotatable on said chamber, nuts threaded on the ends of said chamber and supporting said rings, transmission means connecting said shaft means to said nuts to rotate the nuts in response to rotation of the shaft means to move the rings into and out of sealing position, a lever pivotally supported on the chamber and operatively connected to said shaft means for rotation of the shaft means, and compensating means interposed between said lever and said nuts and operable upon one ring reaching sealing position to permit continued pivotal movement of said lever with continued movement of the other ring toward sealing position.

2. A clamping device according to claim 1 which includes a member connected to said lever and having coaxial internally toothed portions, said shaft means being divided into two parts, and a gear on each shaft part engaging a respective toothed portion of said member, the teeth on said toothed portion and on said gears skewed in respective directions at the opposite ends of said member, said member and shaft parts being relatively moveable in the axial direction.

3. A clamping device according to claim 1 in which said lever is connected to said chamber for tilting the chamber between loading and firing positions relative to said weapon barrel.

4. A clamping device according to claim 1 in which said transmission means includes a skew gear on each end of said shaft means, skew gear teeth on said nuts meshing with said gears, the gear at one end of said shaft means being skewed in a direction opposite to that on the other end of the shaft means, said shaft means being axially moveable on said chamber for purposes of compensation.

5. A clamping device according to claim 1 in which each ring is radially displaceable on the respective nut and at one end sealingly engages the respective nut while at the other end each ring has a sealing surface formed thereon for engagement with the respective one of said weapon barrel and said head.

6. A clamping device according to claim 1 in which each ring is radially displaceable on the respective nut and at one end sealingly engages the respective nut while at the other end each ring has a sealing surface formed thereon for engagement with the respective one of said weapon barrel and said head, each nut having a holding member thereon holding the respective ring captive thereon.

7. A clamping device according to claim 1 in which each ring is radially displaceable on the respective nut and at one end sealingly engages the respective nut while at the other end each ring has a sealing surface formed thereon for engagement with the respective one of said weapon barrel and said head, said one end of each ring having a sealing surface formed thereon for engagement with the respective nut and which surface tapers inwardly toward the respective nut, each nut having a sealing surface facing the respective ring which is complementary in shape to the tapered surface on the ring.

8. A clamping device according to claim 1 which includes a frame in which said chamber is tiltable, a centering pin movable on said chamber and engageable with said frame when the chamber is in firing position, and means connecting said pin to said lever for movement thereby.

9. A clamping device according to claim 1 in which said shaft means is divided into a pair of separate coaxial parts each connected via a respective transmission to a respective nut, an actuator fixed to each shaft part adjacent said lever, and a bar pivotal on said lever and having an end engaging each actuator, said divided shaft means and actuators and bar forming said compensating means.

10. A clamping device according to claim 9 in which each actuator is fork shaped and said bar has cam portions at the ends fitted into the fork shaped actuators.

11. A clamping device according to claim 10 in which said bar is roof shaped in plan view on one side and said lever comprises abutment means on one side of the bar spaced from the bar in the direction of movement of the lever, said abutment means being engageable with the peak of the roof portion of the bar when the lever moves in sealing ring seating direction.

12. A clamping device according to claim 10 in which said lever has other abutment means on the other side of the bar and said bar has laterally spaced protruding regions engageable with said other abutment means.

* * * * *